United States Patent [19]

Kawashima et al.

[11] Patent Number: 5,027,679

[45] Date of Patent: Jul. 2, 1991

[54] FASTENER DRIVER

[75] Inventors: Masaki Kawashima, No. 10-36, Nakano 2-chome, Niiza-shi, Saitama-ken; Kouichi Miyagaki, Toda, all of Japan

[73] Assignee: Masaki Kawashima, Saitama, Japan

[21] Appl. No.: 489,021

[22] Filed: Mar. 6, 1990

[30] Foreign Application Priority Data

Mar. 6, 1989 [JP] Japan ..... 1-53518

[51] Int. Cl.[5] ..... B25B 23/06

[52] U.S. Cl. ..... 81/434; 81/433; 81/57.37

[58] Field of Search ..... 81/57.37, 431, 433, 81/434, 435

[56] References Cited

U.S. PATENT DOCUMENTS 3,971,421 7/1976 Damratowski ..... 81/434

4,428,261 1/1984 Takatsu et al. ..... 81/434

*Primary Examiner*—D. S. Meislin

[57] ABSTRACT

A tubular arrangement the front end of which defines a fastener outlet is extendably and contractably mounted to a fastener driver body. A drive bit is mounted within the tubular arrangement. A fastener feeder is mounted to the tubular arrangement and contains a pair of fastener guiding plates opposite each other with a predetermined distance sufficient to pass a strapped fastener assembly. One of the fastener guiding plates defines a fastener passage opening for feeding a fastener into the tubular arrangement through a fastener feed hole defined in the side wall of the tubular arrangement. A fastener feed mechanism with a feed roller intermittently engaging and advancing the strap is provided. A fastener separation element of a fastener separation mechanism passes into and out of the fastener passage clearance, presses the fastener and separates it from the strap when the fastener separation element extends out of the fastener passage clearance, to feed the separated fastener into the tubular arrangement. First and second actuators both mounted to the fastener driver body actuate the respective fastener feed and fastener separation mechanisms.

8 Claims, 7 Drawing Sheets

FASTENER DRIVER

BACKGROUND OF THE INVENTION

1. Field of the Invention

The present invention relates to a fastener driver driving fasteners, e.g., screws or nails into a workpiece and more particularly to a simply-structured fastener driver which automatically continuously feeds a number of fasteners retained between a pair of straps adhering to each other one by one to the front end of the fastener driver to enable a continuous driving of the fasteners.

2. Description of the Related Art

Hitherto, various fastener drivers in each of which fasteners are continuously mechanically fed to a fastener holder provided at the front end of the fastener driver, i.e., without a need for manually mounting the fasteners one by one to the front edge of a rod-shaped drive bit of the fastener driver and each of which can automatically continuously drive the fasteners have been proposed.

Most of the fastener drivers have employed compressed air for a power source for feeding a fastener to the front end of a fastener driver and on the other hand, a few of the fastener drivers have employed a spring force for the power source.

Since the fastener driver employing compressed air requires an air compressor, the air compressor is very inconveniently translated when the fastener driver must be used in a field job site or the like. On the other hand, even when an air source occasionally is present at the field job site, an air hose must be extended from the air source to the fastener driver, which is inconvenient for handling the fastener driver.

On the other hand, since each of the fastener drivers employing the spring force has a magazine case containing fasteners and a feed mechanism of the magazine both movably mounted to the body of the fastener driver and since both have structures experiencing an impact every time a fastener is fed to the fastener holder provided at the front end of the fastener driver, the fastener driver often fails.

The prior-art fastener drivers employing compressed air or the spring force have the drawbacks described above. In addition, they share a complicated structure as a common drawback in a fastener driver leading to an increase in manufacturing cost and to an increase in the overall size of the fastener driver, which is inconvenient to handle the fastener driver.

SUMMARY OF THE INVENTION

An object of the present invention is to eliminate the drawbacks in the prior-art fastener drivers and to provide a compact, lightweight fastener driver with a simple structure which securely feeds fasteners to the front end of the fastener driver in an interlock with a fastener driving operation of the fastener driver.

In accordance with a fastener driver of the present invention, a tubular arrangement the front end of which defines a fastener outlet is extendably and contractably mounted to a fastener driver body, a drive bit is mounted within the tubular arrangement, a fastener feeder is mounted to the tubular arrangement, the fastener feeder contains a pair of fastener guiding plates opposite each other with a predetermined distance therebetween so that the fastener guiding plates define a fastener passage clearance sufficient to pass a fastener assembly in which a strap retains rod-shaped fasteners extending transversely of and arranged with a predetermined pitch axially of the strap, one of the fastener guiding plates define a fastener passage opening for feeding a front one of the fasteners into the tubular arrangement through a fastener feed hole defined in the side wall of the tubular arrangement, a fastener feed mechanism with a feed roller intermittently engaging and advancing the strap is provided, a fastener separation mechanism of which a fastener separation element passes into and recedes out of the fastener passage clearance through a hole defined in the other fastener guiding plate, presses the front fastener to separate the front fastener from the strap when the fastener separation element extends out of the fastener passage clearance, thereby to feed the separated fastener into the tubular arrangement through the fastener passage opening and fastener feed hole, and a first actuator and a second actuator both mounted to the fastener driver body actuate the respective fastener feed mechanism and fastener separation mechanism.

In the operation of the fastener driver, an operator presses a fastener driver on a workpiece so that the front end of the tubular arrangement is in contact with a desired place of the workpiece. Thereby, the operator first advances the fastener driver body towards the workpiece so that the second actuator concurrently advances to actuate the fastener separation mechanism. That is, the fastener separation element presses the front fastener and separates it from the strap to feed the separated fastener into the tubular arrangement through the fastener passage opening and fastener feed hole.

The operator further advances the fastener driver body so that the front end of the drive bit further advances to fit a groove defined in a head of the front fastener and then push the front fastener out of the fastener outlet. Concurrently, the first actuator advances to actuate the fastener feed mechanism so that the feed roller engages and advances the strap. An advancement of the fastener assembly caused by the feed roller advances a fastener-free portion of the strap from which the last fastener has been separated to a strap outlet defined in the other fastener guiding plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

The preferred embodiments of the present invention will be described in detail with reference to FIGS. 1–9 hereinafter.

Figure 1:
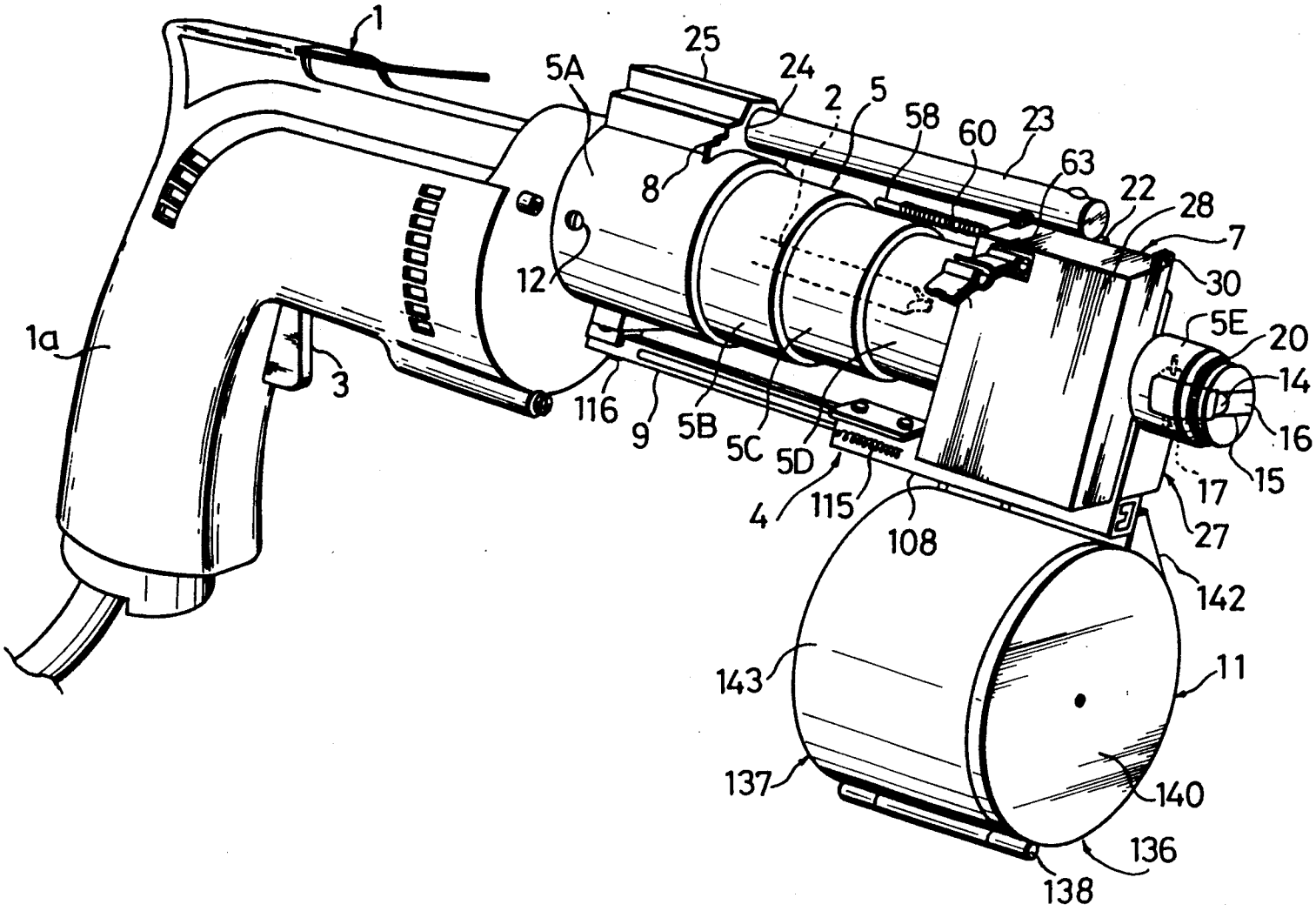
FIG. 1 is a perspective view of a fastener driver according to one embodiment of the present invention.
Figure 2:
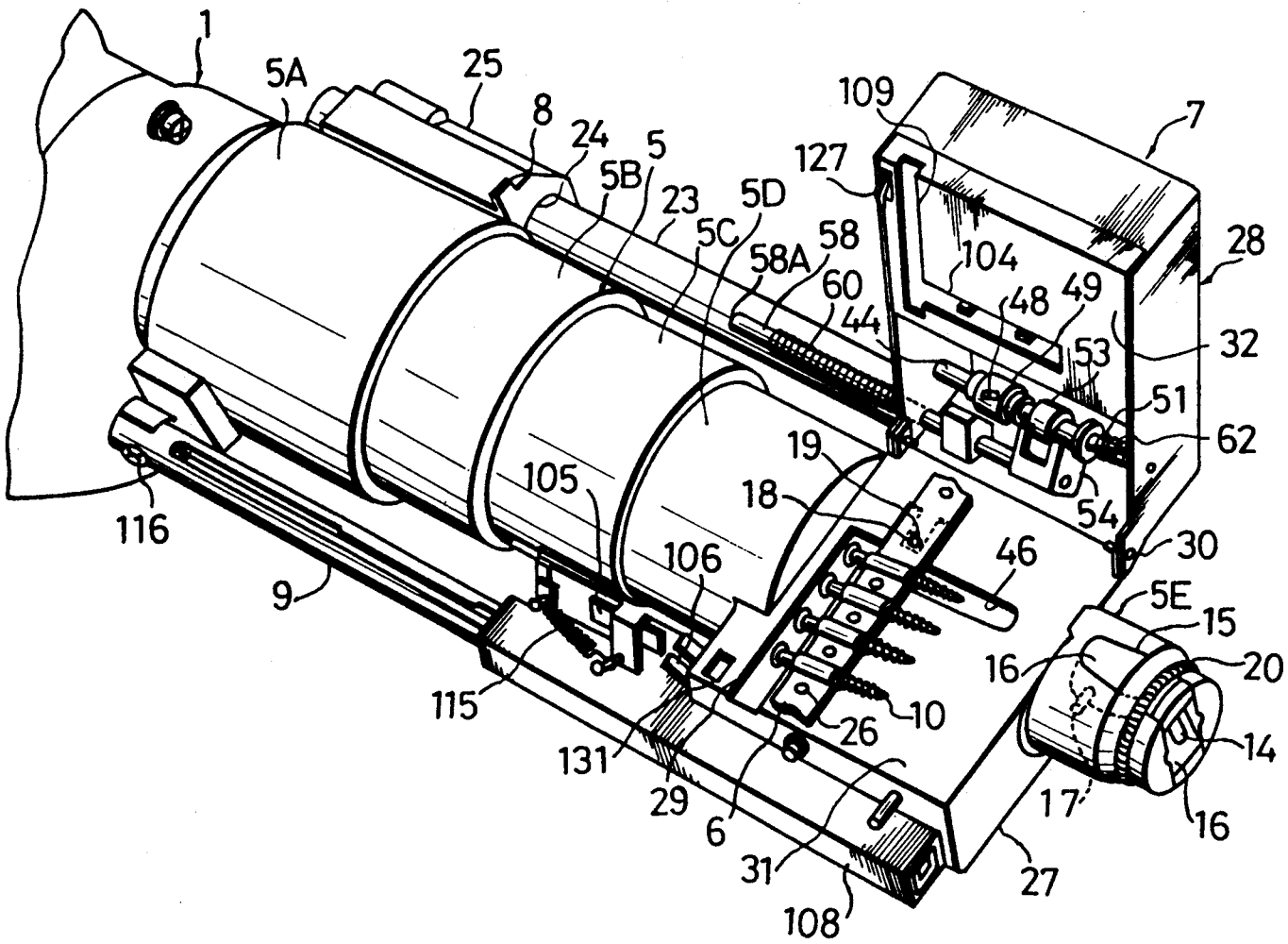
FIG. 2 is a perspective view of a fragment of the fastener driver of FIG. 1 with first and second cases of a fastener feeder opened.
Figure 3:
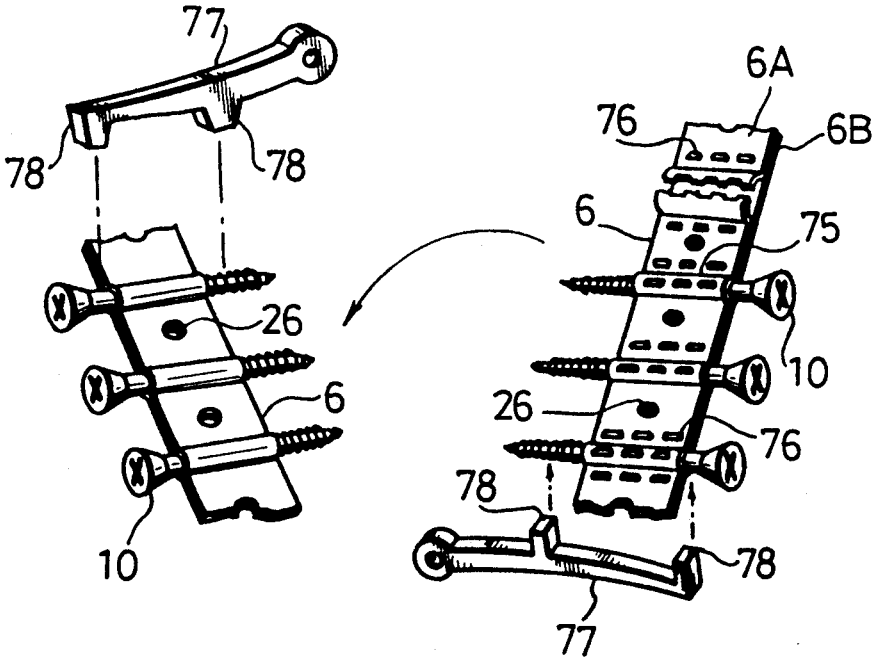
FIG. 3 illustrates front and rear perspective views of a fastener assembly.
Figure 4:
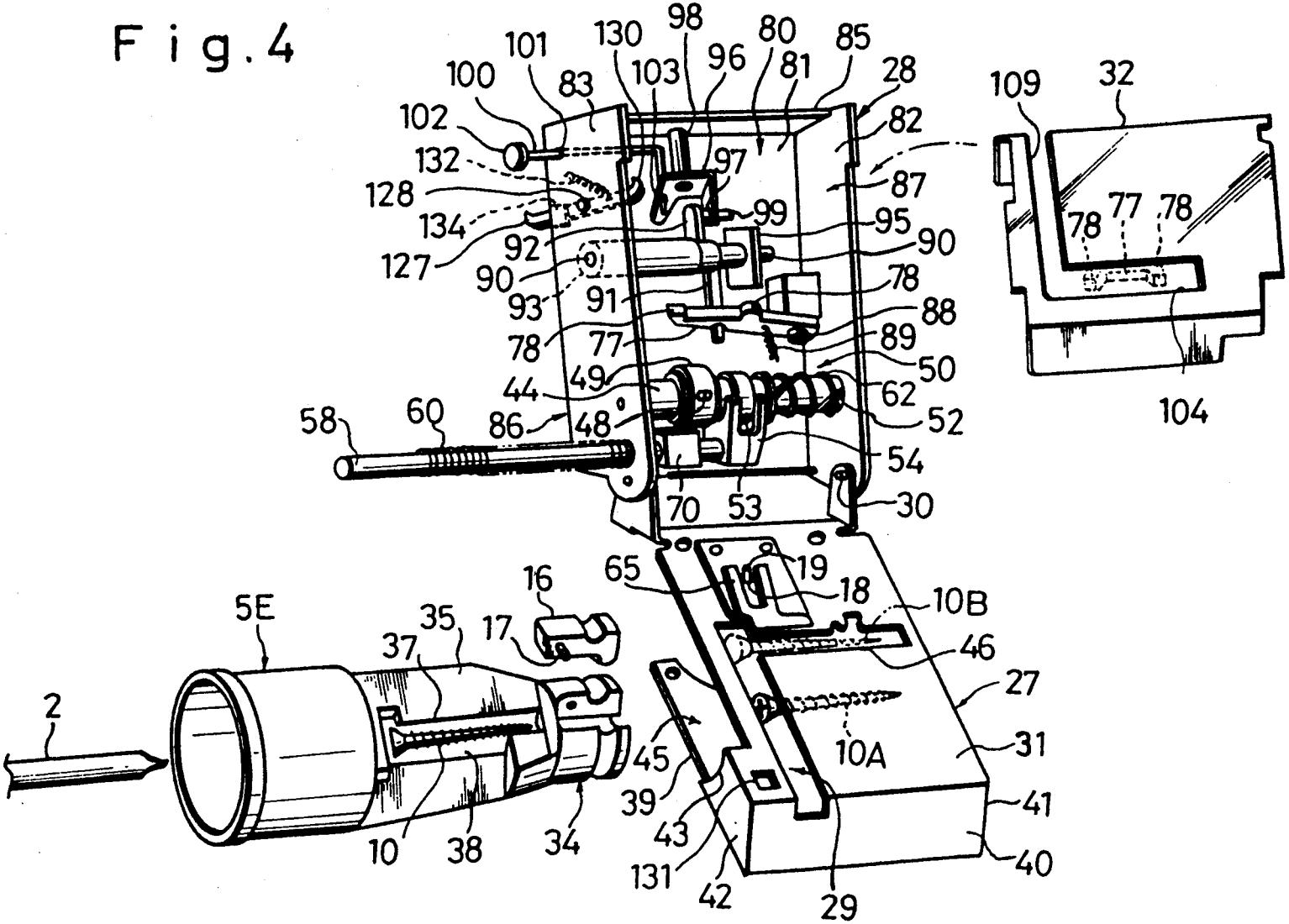
FIG. 4 is a perspective view of the interior of the opened fastener feeder of FIG. 2 with the first and second cases of the fastener feeder opened.

FIG. 1 is a perspective view of a fastener driver (e.g., a screw driver) in an operative position according to one embodiment of the present invention. FIG. 2 is a perspective view of a fragment of the fastener driver with first and second cases of a fastener feeder opened. FIG. 3 illustrated front and rear perspective views of a fastener assembly. FIG. 4 is a perspective view of the interior of the fastener feeder with the first and second cases of the fastener feeder opened.

In each of FIGS. 1–4, a fastener driver body is indicated at 1, a rod-shaped drive bit extending forwardly from the fastener driver body 1 is indicated at 2, a case 1*a* of the fastener driver body 1 containing an electrical motor as a motive source, a trigger switch for actuating of the electrical motor is indicated at 3, and a fastener drive attachment as main part of the present invention is indicated at 4.

The fastener drive attachment 4 comprises a telescopic tubular arrangement 5 which is extendable by a coiled compression spring 13 (see FIG. 5), a fastener feeder 7 mounted to the front end of the telescopic tubular arrangement 5, the fastener feeder 7 delivering fasteners (i.e., screws) 10 connected in sequence by a strap 6 into the telescopic tubular arrangement 5 and sending a fastener-free portion of the strap 6 from which fasteners 10 have been separated, and a first actuator 8 and a second actuator 9 both for actuating the fastener feeder 7. The fastener feeder 7 has a magazine 11 removably mounted thereto containing a fastener assembly in which the strap 6 retains the fasteners 10.

In detail, the telescopic tubular arrangement 5 comprises a first tube 5A, a second tube 5B, a third tube 5C, a fourth tube 5D and a fifth tube 5E arranged in this order from the rear to front of the fastener driver, as shown in FIG. 1. The first tube 5A is removably fixed by means of a machine screw 12 to the case 1*a* of the fastener driver body 1. The telescopic tubular arrangement 5 contains the drive bit 2 and the coiled compression spring 13 (see FIG. 5) exerting a force to the telescopic tubular arrangement 5 so as to extend the respective second to fifth tubes 5B to 5E. The fifth tube 5E constituting the front end of the telescopic tubular arrangement 5 defines a fastener outlet 14.

A pair of nosepieces 16 are provided in the fastener outlet 14 and pivotably mounted by means of a pair of pins 17 to a pair of notch defining portions of the wall of the fifth tube 5E opposite each other. An annular coiled spring 20 fits the outer cylindrical surfaces of the nosepieces 16 and fifth tube 5E. When a front fastener 10B is driven, the front fastener 10B forcibly opens the nosepieces 16 against the force of the annular coiled spring 20 and is pushed out of the fastener outlet 14. In this state, once an operator manually pushes the trigger switch 3, the electrical motor moves to rotate the drive bit 2. The rotating drive bit 2 rotates the front fastener 10 fitting the front edge of the drive bit 2 to drive the fastener 10 into the workpiece.

Figures 8, 9:
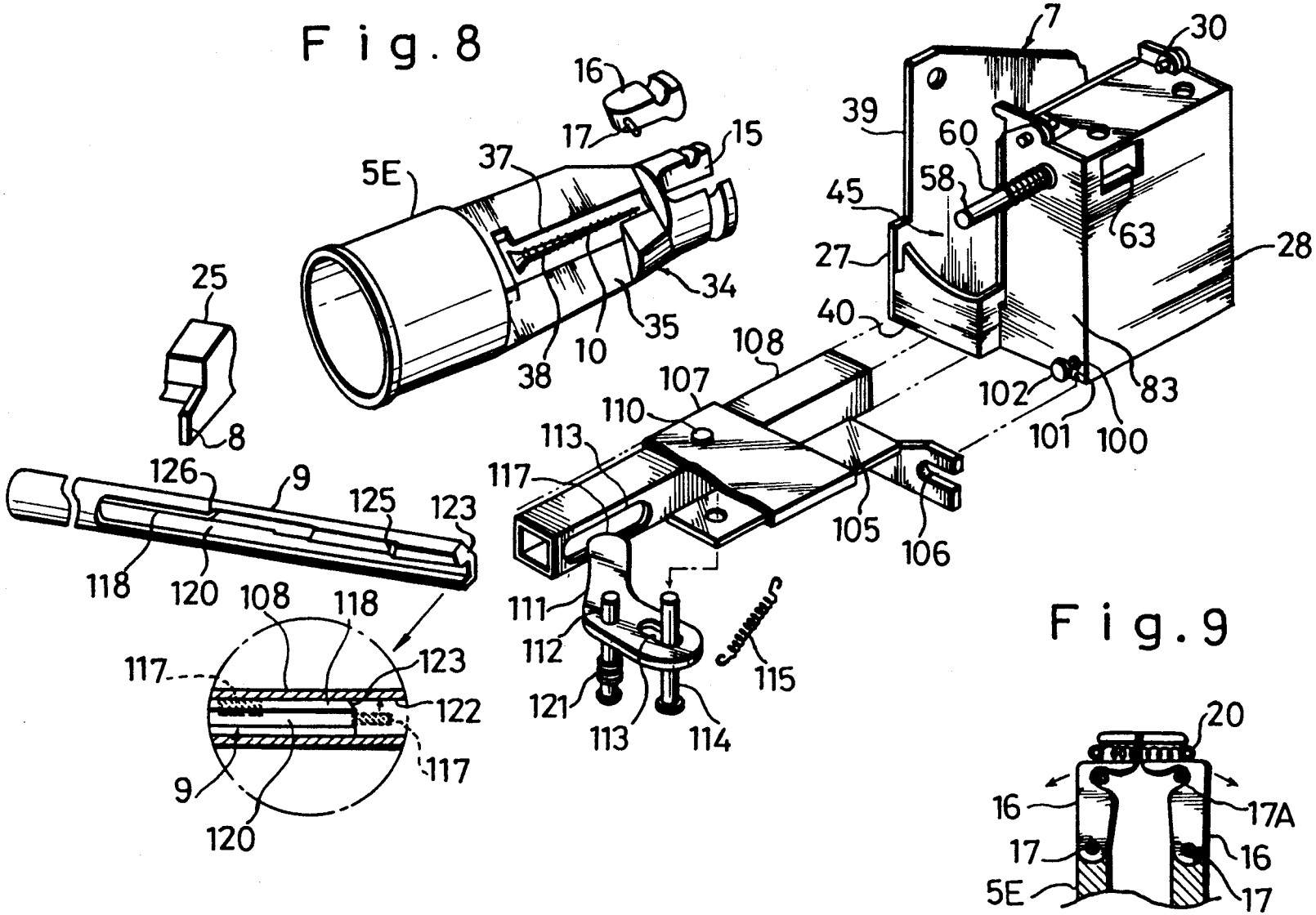
FIG. 8 is an exploded perspective view of a fastener feed mechanism.
FIG. 9 is an illustration of nosepieces provided at the front end of a tubular arrangement of the fastener driver of FIG. 1.

As shown in FIG. 9, a pair of stop pins 17A are each provided inside a nosepiece 16 between opposite wall surfaces defining a notch 15 in the fifth tube 5E. Each of the stop pins 17A stops an excessive inwardly-pivotal movement of a corresponding one of the right-hand and left-hand nosepieces 16 by means of being in contact with an inner surface of the corresponding one of the nosepieces 16. Thus, the stop pins 17A prevent the nosepieces 16 from being out of alignment with the fifth tube 5E so as to ensure a normal drive of a fastener 10 into the workpiece.

In order to smoothly extend and contract the second to fifth tubes 5B to 5E, the front end of a guide bar 23 is fixed by means of a mount 22 to the top portion of the cylindrical wall of the fifth tube 5E, a guiding support 25 with a guiding hole 24 is mounted on the top portion of the cylindrical wall of the first tube 5A and the guide bar 23 is slidably mounted within the guiding hole 24.

Thus, as the telescopic tubular arrangement 5 is extended or contracted, the guide bar 23 moves forwards or backwards within the guiding hole 24 and constitutes a reinforcement for the telescopic tubular arrangement 5, so that the second to fifth tubes 5B to 5E are smoothly extended or contracted. Since the telescopic tubular arrangement 5 is divided into a plurality of stages, i.e., the first to fifth tubes 5A to 5E, the length of the telescopic tubular arrangement 5 in a contracted position secures a larger amount of a projection of the front edge of the drive bit 2 from the fastener outlet 14. Alternatively, a single bellows-shaped tube may be employed instead of the telescopic tubular arrangement 5. The bellows-shaped tube is mounted to the fastener driver body 1 so as to be extendable and contractable by a spring. When the bellows-shaped tube is in a contracted position, the front edge of the drive bit 2 is projected from the fastener outlet in the front end of the bellows-shaped tube so as to drive the front fastener 10B forwards out of the fastener outlet.

The fastener feeder 7 will be described with reference to FIG. 1 to 8 hereinafter.

Figure 5:
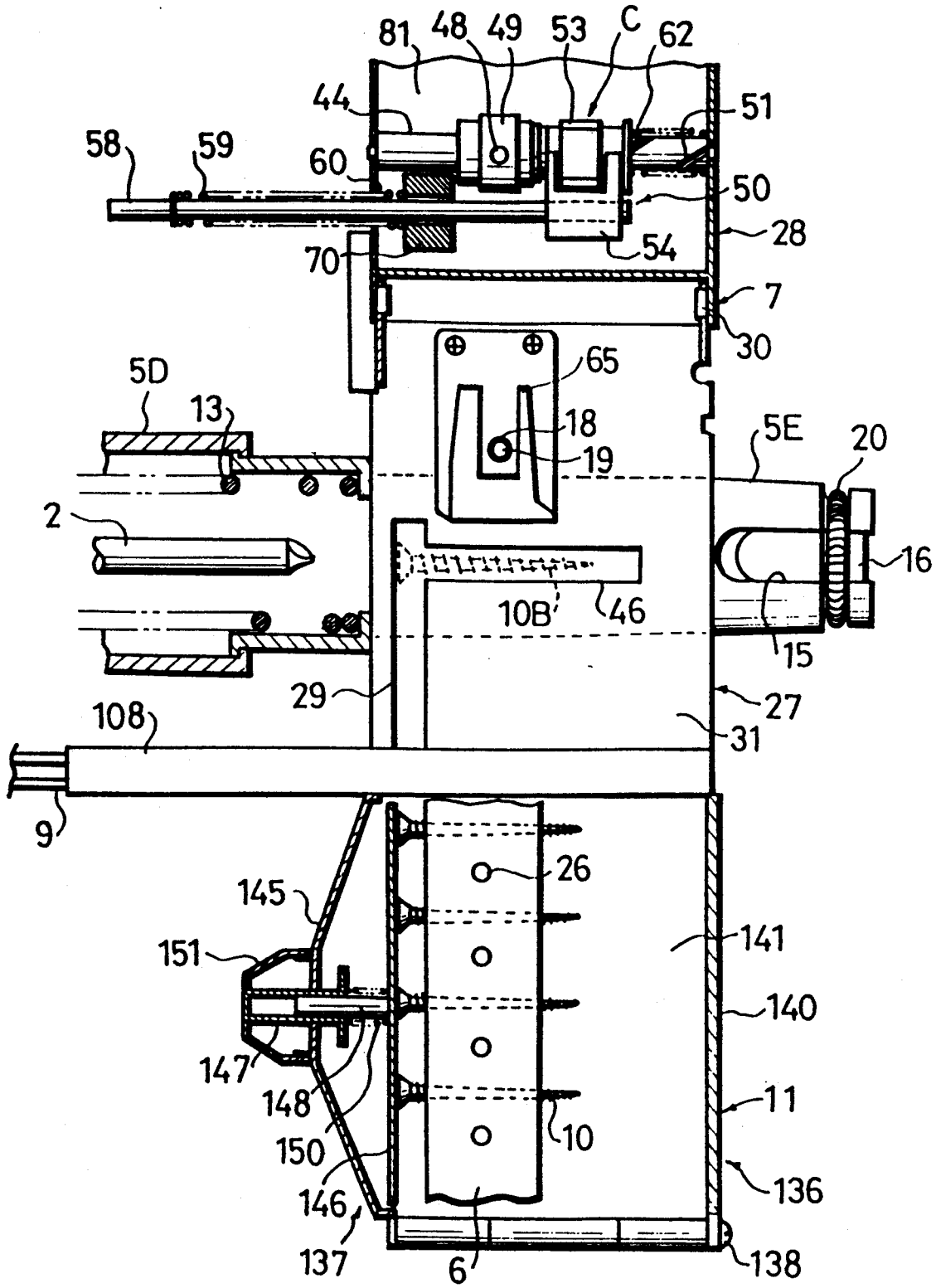
FIG. 5 is a front sectional view of the interior of the fastener feeder of FIG. 2 with the first and second cases opened.
Figure 6:
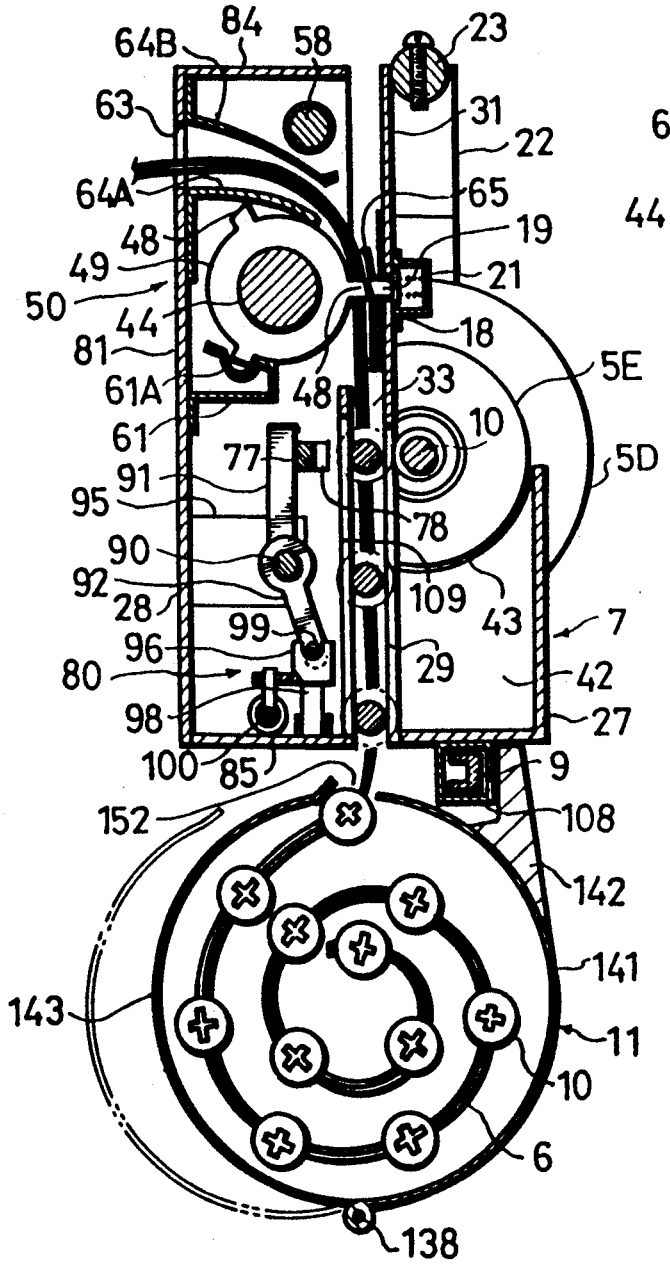
FIG. 6 is a cross section of the fastener feeder of FIG. 2 with the first and second cases closed.

As shown in FIGS. 1, 2, 4, 5, 6 and 8, the fastener feeder 7 comprises a first case 27 and a second case 28 associated with each other by means of a pair of pins 30 and openable and closable about the pins 30. As shown in FIG. 6, the first case 27 has a first guiding plate 31 and the second case 28 has a second guiding plate 32 so that a combination of the guiding plates 31 and 32 guides advancements of the fasteners 10 from the magazine 11 to a fastener passage opening 46 defined in the first guiding plate 31. When the fastener feeder 7 is mounted to the fifth tube 5E and the first and second cases 27 and 28 are closed, the first and second guiding plates 31 and 32 define therebetween a fastener passage clearance 33 allowing the fastener assembly to pass through.

A relationship between the first case 27 and fifth tube 5E will be described with reference to FIGS. 4 and 5 hereinafter. Opposite portions of the cylindrical wall of the fifth tube 5E define a pair of cut faces 35 except the front end 34 of the fifth tube 5E (however, FIG. 4 can show only one cut face 35). The one cut face 35 defines a fastener feed hole 37 through which the front fastener 10B can pass from the outside of the fifth tube 5E into the interior 38 of the fifth tube 5E. The first guiding plate 31 defines a guiding groove 29 extending along the axis of the first guiding plate 31. An enlarged head of the fastener 10 slidably engages the lower edge of the guiding groove 29 and advances along the guiding groove 29.

The first case 27 comprises the first guiding plate 31, a side plate 39 extending in parallel to the first guiding plate 31, a bottom plate 40 extending between the first guiding plate 31 and side plate 39, a front plate 41 and a rear plate 42 both having a predetermined height, and upper arc-shaped edges 43 of the front and rear plates 41 and 42 so as to define a spacing 45. As shown in FIG. 5, the first guiding plate 31 defines a fastener passage opening 46 in alignment with the fastener feed hole 37 defined in the fifth tube 5E when the fastener feeder 7 is mounted to the fifth tube 5E.

As best shown in FIG. 5, the first guiding plate 31 of the first case 27 defines a circular hole 18 through which a positioning pin 19 movably extends towards the second guiding plate 32. A coiled compression spring 21 seated in a bracket mounted on the first guiding plate 31 is in contact with the rear end of the positioning pin 19 and urges the positioning pin 19 towards the second guiding plate 32.

As shown in FIG. 6, the positioning pin 19 has an oblique front edge surface and engages any of feed pitch holes 26 defined along the axis of the strap 6, so as to facilitate the fastener assembly to be loaded on a fastener feed mechanism 50 described hereinafter. A positioning mechanism related with the positioning pin 19 may be eliminated.

The fastener feed mechanism 50 and a fastener separation mechanism 80 both provided in the second case 28 will be described with reference to FIGS. 2 to 5 hereinafter.

As best shown in FIGS. 4 and 6, the second case 28 comprises a box-type case body 86 with one open side 87, and the second guiding plate 32 mounted within the open side 87. The case body 86 has a side plate 81, a front plate 82, a rear plate 83, a top plate 84 and a bottom plate 85.

The fastener feed mechanism 50 comprises a rotatable shaft 44 the opposite ends of which are supported on the front and rear plates 82 and 83 of the second case 82. The rotatable shaft 44 has a feed roller 49 fixed thereto and having three projections 48 equiangularly arranged circumferentially of the feed roller 49. The projections 48 are inserted into the feed pitch holes 26 in the straps 6 when the fastener assembly is loaded on the fastener feeder 7 and when the first and second cases 27 and 28 are closed.

Figure 7A:
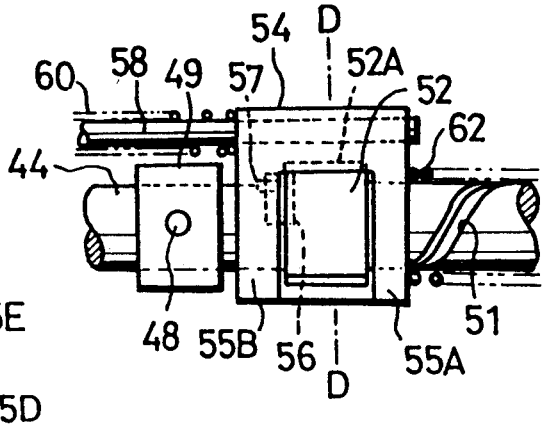
FIG. 7(A) is an enlarged view of a C-portion of FIG. 5.
Figure 7B:
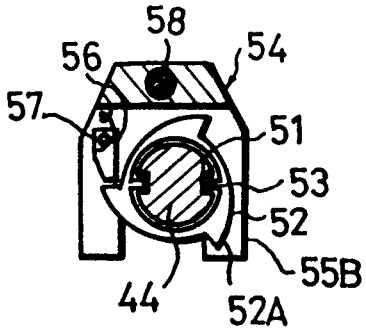
FIG. 7(B) is a sectional view taken along the D—D line in FIG. 7(A)

As shown in FIGS. 7(A) and 7(B), the cylindrical surface of the rotatable shaft 44 defines a pair of spiral grooves 51. An annular ratchet wheel 52 is axially slidably mounted on the rotatable shaft 44. The outer circumference of the ratchet wheel 52 has three teeth 52A equiangularly arranged circumferentially of the ratchet wheel 52. The inner circumference of the ratchet wheel 52 has two opposite projections 53 engaging the spiral grooves 51.

The ratchet wheel 52 is seated in an actuation block 54 moving the ratchet wheel 52 along the rotatable shaft 44. As shown in FIG. 7(A), the actuation block 54 has a side view in the form of yoke, i.e., a rectangular-U shape and a front prong 55A and a rear prong 55B between which the ratchet wheel 52 is seated. As shown in FIG. 7(B), a pawl 56 is pivotably mounted by means of a pivot 57 on the inside of the rear prong 55B. The pawl 56 is engageable with each of the teeth 52A so as to block a reversed rotation of the ratchet wheel 52 and thereby secure only a normal rotation the ratchet wheel 52. As shown in FIG. 4, the actuation block 54 is fixed to the front end of an actuation rod 58. The actuation rod 58 is supported by means of a support block 70 fixed to the inner surface of the side plate 81 of the second case 28, on the side plate 81 and extends movably through the rear plate 83 of the second case 28 so as to extend towards the fastener driver body 1. As shown in FIG. 5, coiled compression springs 59 and 60 seated around the actuation rod 58 between the support block 70 and a retainer fixed to the actuation rod 58 serves to damp the axial movement of the actuation rod 58 at the front and rear limits of the axial movement of the actuation rod 58. As shown in FIG. 6, a leaf spring 61 has a rear end fixed to the inner surface of the side plate 81 of the second case 28 and a front end having a recess 61A. The recess 61A removably engages each of the projections 48 of the rotating feed roller 49 intermittently so as to secure an accurate stop position of the feed roller 49. Leaf springs 64A and 64B opposite each other through a strap outlet 63 defined in the side plate 81 are fixed to the inner surface of the side plate 81 of the second case 28 and extend towards the first case 27. The leaf springs 64A and 64B guide a sending of a fastener-free portion of the strap 6 from which the fasteners 10 have been separated. A return compression spring 62 is seated around the rotatable shaft 44 between the front plate 82 and actuation block 54 and returns rearwards the actuation block 54 which has moved to the front end of the rotatable shaft 44, when the telescopic tubular arrangement 5 is in an extended position. The side plate 81 of the second case 28 defines the strap outlet 63 through which the fastener-free portion of the strap 6 is discharged. A retaining leaf spring 65 is fixed to the inner surface of the first guiding plate 31 around the positioning pin 19. The retaining leaf spring 65 lightly presses the fastener-free portion of the strap 6 on the cylindrical surface of the feed roller 49.

A manner of loading the fastener assembly on the fastener feed mechanism 50 will be described hereinafter. As shown in FIG. 2, the rear portion of the strap 6 retaining the fasteners 10 is brought into contact with the inner surface of the first guiding plate 31 so that the positioning pin 19 extending from the first guiding plate 31 towards the second case 28 passes through a feed pitch hole 26 in the strap 6 to provisionally position the fastener assembly loaded on the first guiding plate 31. In this state, the front fastener 10B at the front position of a fastener sequence is positioned in the fastener passage opening.

In this state, when the first and second cases 27 and 28 are closed together, the front edge of each projection 48 of the feed roller 49 is brought into contact with the front edge of the positioning pin 19 mounted to the first case 27 to push the positioning pin 19 against the force of the coiled compression spring 21. Thus, the positioning pin 19 is removed out of the feed pitch hole 26 in the strap 6 of the fastener assembly and the projection 48 of the feed roller 49 is immediately inserted into the same feed pitch hole 26. In the insertion of the projection 48 into the feed pitch hole 26, the contacting, oblique edges of the positioning pin 19 and projection 48 prevent both the positioning pin 19 and projection 48 from disengaging from the feed pitch hole 26.

The rear edge 58A of the actuation rod 58 is spaced a predetermined distance from the first actuator 8. Thus, when in fastener drive, the front end of the fifth tube 5E is brought into contact with the workpiece and the operator pushes the fastener driver body 1 towards the workpiece so that the telescopic tubular arrangement 5 is contracted, the first actuator 8 advances the predetermined distance to come into contact with the rear edge 58A of the actuation rod 58 and thereby advance the actuation rod 58. The advancement of the actuation rod 58 advances the ratchet wheel 52 by means of the actuation block 54 fixed to the actuation rod 58. The ratchet wheel 52, a reversed rotation of which is blocked by the combination of the teeth 52A and pawl 56, advances along the rotatable shaft 44 without rotating, so that the camming engagement between the projections 53 of the ratchet wheel 52 and the spriral grooves 51 in the rotatable shaft 44 rotates the rotatable shaft 44 by a predetermined angles, i.e., 120°. The 120° rotation of the rotatable shaft 44 rotates the feed roller 49 by 120° so that the projection 48 advances the strap 6 of the fastener assembly by a distance corresponding to 120°.

After completion of fastener drive, the fastener driver body 1 is moved rearwards away from the workpiece so that the force of the coiled compression spring 62 seated around the rotatable shaft 44 moves the actuation block 54 and ratchet wheel 52 rearwards. Thus, the camming engagement between the projections 53 of the ratchet wheel 52 and the spriral grooves 51 in the rotatable shaft 44 rotates the ratchet wheel 52 counterclockwise in FIG. 7(B) as the ratchet wheel 52 is moved rearwards, so that the rotatable shaft 44 cannot be reversely rotated. Thus, only a one-directional rotation of the feed roller 49 can be intermittently performed in order to advance the strap 6 of the fastener assembly.

The fastener assembly with the strap 6 will be described with reference to FIG. 3 hereinafter. The strap 6 comprises a pair of paper strap halves 6A and 6B each made, e.g., of kraft paper. Each of the contacting surfaces of the paper strap halves 6A and 6B has a laminated layer made of a plastic film, e.g., polyethylene film (not shown). The paper strap halves 6A and 6B sandwich the fasteners 10 each extending transversely of the paper strap halves 6A and 6B and generally arranged along the paper strap halves 6A and 6B with a fixed pitch. The enlarged head of each fastener 10 is positioned above the upper edge of the strap 6 and the pointed end of each fastener 10 is positioned below the lower edge of the strap 6. A portion of the strap 6 in front of each fastener 10 and a portion of the strap 6 in rear of that fastener 10 are heat sealed thereby to define a tubular fastener retainer 75 retaining that fastener 10.

The paper strap half 6A defines separation holes so that each fastener 10 is readily separated from the strap 6 when that fastener 10 is driven. In particular, as shown in the right-hand side of FIG. 3, the paper strap half 6A defines perforations 76 arranged transversely of the strap 6 each in front of and in rear of each fastener retainer 75 and on each fastener retainer 75. Alternatively, only the perforations 76 on each fastener retainer 75 may be provided. The other paper strap half 6B has no separation holes.

Thus, a fastener separation lever 77 as shown in FIG. 3 (the structure and operation of the separation lever 77 will be later described in detail) has upper and lower projections 78 respectively pressing a neck and shank of the front fastener 10B from the side of the other paper strap half 6B to tear a corresponding fastener retainer 75 by means of the perforations 76 in the one paper strap half 6A so that the front fastener 10B is readily separated from the strap 6.

As described above, the center of the width of each portion of the strap 6 between adjacent fastener retainers 75 defines the feed pitch hole 26.

The fastener separation mechanism 80 provided in the second case 28 will be described with reference to FIGS. 2, 3, 4 and 6 hereinafter. As best shown in FIG. 4, the lower end of the fastener separation lever 77 is pivotably mounted on and within the second case 28 by means of a pivot 88 (a machine screw is employed as shown in FIG. 4) and urged towards the side plate 81 of the second case 28 by means of a coiled tension spring 89.

As shown in FIG. 4, a first arm is indicated at 91 and a second arm is indicated at 92. The first and second arms 91 and 92 extend oppositely sidewards from a hollow cylinder 93 rotatably mounted on a shaft 90 fixed to the rear plate 83 of the second case 28. The front end of the first arm 91 engages a rear portion of the fastener separation lever 77. One end of the shaft 90 is fixed to the rear plate 83 of the second case 28 and the other end of the shaft 90 is supported on a bracket 95 fixed to the inner surface of the side plate 81.

A front end of the second arm 92 has a pin 99 extending forwards. The pin 99 passes through a U-shaped notch 97 of a yoke portion of an oscillator 96 made with an L-shaped metal plate so as to engage the two prongs of the yoke portion. The oscillator 96 is pivotably mounted on a pivot pin 98 fixed to the inner surface of the bottom plate 85 of the second case 28.

As shown in FIG. 4, a pull bar is indicated at 100. The pull bar 100 slidably passes through a hole 101 defined in the rear plate 83 of the second case 28. An outer end of the pull bar 100 has a disc-shaped flange 102. An inner portion of the pull bar 100 is bent at a right angle. An inner end of the pull bar 100 is inserted through a hole 103 defined in the oscillator 96.

Thus, when the second guiding plate 32 is mounted within a side opening of the case body 86 of the second case 28 as shown in FIG. 6 and then the pull bar 100 is moved rightwards and leftwards as shown by arrows in FIG. 4, the second arm 92 rotates the fastener separation lever 77 about the pivot 88 through a linkage of the pull bar 100, oscillator 96, pin 99, first arm 91 and hollow cylinder 93 against and by the force of the coiled tension spring 89.

When the fastener separation lever 77 is moved against the force of the coiled tension spring 89, the upper and lower projections 78 of the fastener separation lever 77 extend out of a rectangular opening 104 defined in the second guiding plate 32 towards the first guiding plate 31 of the first case 27 and press the neck and shank of the front fastener 10B retained in the strap 6 to separate the front fastener 10B from the strap 6.

As shown in FIG. 4, the second guiding plate 32 defines a fastener head guiding groove 109 communicating with the rectangular opening 104 and opposite the guiding groove 29 in the first guiding plate 31 when the first and second cases 27 and 28 are closed.

When the first and second cases 27 and 28 are closed, the fastener separation lever 77 is opposite fastener passage opening 46 defined in the first guiding plate 31 so that the projections 78 of the fastener separation lever 77 can press the front fastener 10B positioned within the fastener passage opening 46 and retained in the strap 6. Thus, the projections 78 extend out of the rectangular opening 104 in the second guiding plate 32 to tear the fastener retainer 75 at the perforations defined on the fastener retainer 75 and thereby separate the front fastener 10B from the strap 6. Then, the fastener separation lever 77 delivers the front fastener 10B into the fifth tube 5E through the fastener passage opening 46 in the first guiding plate 31 and the fastener feed hole 37 in the fifth tube 5E.

The drive bit 2 pushes the front fastener 10B which has been fed into the fifth tube 5E so that the front edge of the drive bit 2 fits a plus-shaped groove in the head of the front fastener 10B. The front fastener 10B forcibly opens the nosepieces 16 against the force of the annular spring 20 and then is rotated to be driven into the workpiece.

An actuation mechanism for the fastener separation mechanism 80 will be described with reference to FIG. 8 hereinafter. As shown in FIG. 8, a slide plate the front end of which is bent at a right angle to the body of the slide plate and terminates at a yoke with a U-shaped notch 106 is indicated at 105. The yoke with the U-shaped notch 106 engages the disc-shaped flange 102 provided on the outer end of the pull bar 100. A retaining plate 107 retains the slide plate 105 and moves the slide plate 105 forwards and rearwards. A rectangular tubular guide for a second rod-shaped actuator 9 slidably mounted therewithin is indicated at 108. The top surface of the front end of the tubular guide 108 is welded to the underside of the bottom plate 40 of the first case 27. The retaining plate 107 is spot-welded at 110 to the top surface of the tubular guide 108.

A lever pivotably mounted by means of a pivot 112 to the underside of the retaining plate 107 is indicated at 111. The lever 111 has a slot 113 extending axially thereof. A pin 114 passes freely through the slot 113 and has the top end fixed to the underside of the slide plate 105. A coiled tension spring 115 one end of which is mounted to the pin 114 urges the lever 111 to rotate counterclockwise about the pivot 112. Thus, as the lever 111 is rotated clockwise and counterclockwise in FIG. 8, the slide plate 105 is moved rearwards and forwards.

A relationship between the second rod-shaped actuator 9 and lever 111 will be described hereinafter. The second rod-shaped actuator 9 has a portion with a predetermined length extending between the front edge and an intermediate portion and having a rectangular U-shaped cross-section. The rear end of the second rod-shaped actuator 9 is fixed by means of a machine screw 116 to the underside of the outer cylindrical surface of the first tube 5A as shown in FIGS. 1 and 2. When the second rod-shaped actuator 9 is within the tubular guide 108, an upright end 117 of the lever 111 passes through a slot 113 defined in a side wall of the tubular guide 108 and extending axially of the tubular guide 108 into the tubular guide 108 and is in contact with vertical actuating surfaces 118 or the bottom surface of a groove 120 extending axially of the second rod-shaped actuator 9 when the second rod-shaped actuator 9 is moved forwards or rearwards axially of the tubular guide 108.

The relationship between the second rod-shaped actuator 9 and lever 111 will be described in more detail hereinafter. A coiled compression spring 121 is seated around a pivot 112 and urges the lever 111 upwards in FIG. 8. As shown in an encircled enlarged view of FIG. 8, when the upright end 117 of the lever 111 passes through the slot 113 into the tubular guide 108 and when the front edge 123 of the second actuator 9 moves leftwards in the encircled enlarged view of FIG. 8 and disengages from the upright end 117 of the lever 111, the upright end 117 of the lever 111 is immediately lifted up and brought into the inner surface of the top wall 122 of the tubular guide 108 by the force of the coiled compression spring 121 so that the position of the upright end 117 of the lever 111 is as high as that of the vertical actuating surfaces 118. In this state, the lever 111 is rotated counterclockwise in FIG. 8 by the force of the coiled tension spring 115 until the upright end 117 of the lever 111 is brought into contact with the rear edge of the slot 113 defined in the tubular guide 108.

In this state, when the second actuator 9 is advanced, the upright end 117 of the lever 111 rides on the front stage of the vertical actuating surfaces 118 so that the lever 111 is rotated clockwise in FIG. 8 against the force of the coiled tension spring 115 until the upright end 117 of the lever 111 is brought into contact with the front edge of the slot 113 defined in the tubular guide 108. Thereby, the slide plate 105 is moved rearwards (i.e., leftwards in FIG. 8) to pull the pull bar 100 (i.e., move leftwards in FIG. 8).

As described above, pulling the pull bar 100 extends the projections 78 of the fastener separation lever 77 out of the rectangular opening 104 defined in the second guiding plate 32 towards the first guiding plate 31 to separate the front fastener 10B from the strap 6. As shown in FIG. 8, since the vertical actuating surfaces 118 have a plurality of steps 125, they stepwise control the rotation of lever 111 so that the projections 78 of the fastener separation lever 77 are moved stepwise with accelerations to easily separate the front fastener from the strap 6.

The rearmost edge of the rearmost stage of the vertical actuating surfaces 118 has an oblique underside surface 126 projecting transversely of the second actuator 9 and extending to the bottom of the groove 120. Thus, when the second actuator 9 advances a predetermined distance until the upright end 117 of the lever 111 is brought into the oblique underside surface 126, the upright end 117 of the lever 111 immediately is slid by the force of the coiled tension spring 115 along the oblique underside surface 126 to the bottom of the groove 120 while the lever 111 is descended along the pivot 112 against the force of the coiled compression spring 121.

As the lever 111 is concurrently rotated counterclockwise about the pivot 112 in FIG. 8, the slide plate 105 is advanced to return the pull bar 100 to its initial position. Thereby, the fastener separation lever 77 exits out of the rectangular opening 104 defined in the second guiding plate 32 to complete the separation of the front fastener 10B from the strap 6.

When the upright end 117 of the lever 111 has fallen to the bottom of the groove 120, the lever 111 cannot receive an effect of a backward movement of the second actuator 9. When the second actuator 9 is moved to its backwardmost position, the front edge 123 of the second actuator 9 releases the upright end 117 of the lever 111 which in turn is repeatedly lifted up to the position of the vertical actuating surfaces 118 of the second actuator 9 to provide for a next stroke of fastener drive.

The fastener driver separates from the strap 6 the front fastener 10B positioned within the fastener passage opening 46 defined in the first guiding plate 31 and feeds the front fastener 10B into the fifth tube 5E in one stroke of fastener drive in which an operator presses the front edge of the fifth tube 5E on the workpiece to contract the telescopic tubular arrangement 5 and drives the front fastener 10B into the workpiece.

In the stroke of fastener drive, the second actuator 9 actuates the pull bar 100 for the predetermined period of time corresponding to the initial distance between the first actuator 8 and the rear end 58A of the actuation rod 58 before the first actuator 8 is brought into contact with the rear end 58A of the actuation rod 58, so that the operator initially presses the fifth tube 5E on the workpiece, then the second actuator 9 actuates the fastener separation mechanism 80 to separate the front fastener 10B from the strap 6 and then feed the separated front fastener 10B into the fifth tube 5E. Then, the first actuator 8 actuates the fastener feed mechanism 50 to advance the fastener assembly by means of the engagement of the projection 48 of the feed roller 49 with the feed pitch hole 26 defined in the strap 6 and thereby feed a next fastener 10A into the fastener passage opening 46 defined in the first guiding plate 31.

As shown in FIG. 6, the fastener feed operation of the feed roller 49 advances the fastener-free portion of the strap 6 through the spacing between the pair of leaf springs 64A and 64B both extending along the outer cylindrical surface of the feed roller 49 and through the strap outlet 63 defined in the side plate 81 of the second case 28 out of the second case 28.

As shown in FIG. 4, a lock lever pivotably mounted on the inner surface of the rear plate 83 of the second case 28 by means of a pivot 128 is indicated at 127. The lock lever 127 extends between the outside and inside of the second case 28 and has an inner end with a bent pawl 130.

When the first and second cases 27 and 28 are closed, the pawl 130 of the lock lever 127 engages an edge of a lock hole 131 defined near a corner of the first guiding plate 31 of the first case 27 to lock the first and second cases 27 and 28 in their closed positions. A coiled tension spring 132 urges the lock lever 127 so that the pawl 130 engages the edge of the lock hole 131. The operator can grip the outer end of the lock lever 127 and rotate the lock lever 127 against the force of the coiled tension spring 132 in order to disengage the pawl 130 from the lock hole 131 and open the first and second cases 27 and 28.

A magazine 11 will be described with reference to FIGS. 1, 5 and 6 hereinafter. The magazine 11 comprises a fixed body 136 and movable element 137 associated with the fixed body 136 by means of pivot 138. The fixed body 136 comprises a front disc 140 and semicylindrical wall 141 integrated with each other. The semicylindrical wall 141 has a mount bracket 142 by means of which the fixed body 136 is attached by means of a screw or the like to the tubular guide 108. On the other hand, the magazine movable element 137 comprises a truncated conical cap 145 opposite the front disc 140 when the magazine 11 is in a closed position, and a semicylindrical wall 143 mating with the semicylindrical wall 141 of the fixed body 136. The magazine movable element 137 contains a pushing plate 146 in contact with and slightly presses the enlarged heads of the fasteners 10 of the spriraled fastener assembly, the pushing plate 146 being movably mounted within the magazine movable element 137.

In more detail, a tubular guide 147 passes through a hole defined in the center of the cap 145 and is fixed to the cap 145. A shaft 148 extending from the pushing plate 146 passes into and is movable axially of the tubular guide 147. A coiled compression spring 150 is seated around the shaft 148 between the pushing plate 146 and a retainer provided at a free end of the tubular guide 148 so as to urge the pushing plate 146 to slightly push the heads of the fasteners 10. The outer surface of the truncated portion of the cap 145 has a nob 151 to handle the magazine movable element 137.

In an operation of charging the fastener assembly in the magazine 11, the operator opens the magazine movable element 137 about the pivot 138, then charges the spiraled fastener assembly having the strap 6 and extends a front portion of the fastener assembly out of an opening 152 defined in the magazine 11, and then closes the magazine movable element 137 as shown in FIG. 6. An illustration of a latch holding the magazine movable element 137 in a closed position is eliminated.

As described above, the operator opens the second case 28 of the fastener feeder 7 after charging the fastener assembly in the magazine 11 and mounts a front portion of the fastener assembly which retains some fasteners 10 to the first guiding plate 31 so that the positioner 19 passes through a feed pitch hole 26 defined in the strap 6. Then, the operator closes the second case 28 to the first case 27. After the completion of a fastener assembly setting, the operator can freely drive the fasteners 10 in accordance with the stroke of fastener drive.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fastener driver for a fastener assembly of fasteners arranged with a predetermined pitch along an axis of a strap retaining the fasteners, comprising:

a fastener driver body having a rod-shaped drive bit rotated by a powered motive source;

a tubular arrangement mounted to said fastener drive body, the tubular arrangement being extendable and contractable axially of said tubular arrangement, said tubular arrangement having a front end defining a fastener outlet, the drive bit being advanced in and axially of said tubular arrangement when a fastener is driven; and a fastener feeder mounted to said tubular arrangement, said fastener feeder including (a) to (e), (a) a pair of fastener guiding plates essentially in parallel to each other defining therebetween a clearance of a sufficient width to freely pass a fastener assembly, one of the fastener guiding plates being positioned relative to a wall of said tubular arrangement so that a fastener feed hole defined in the wall of said tubular arrangement is opposite a fastener passage opening defined in the one fastener guiding plate, (b) means for separating a fastener from the fastener assembly and for pushing the separated fastener into said tubular arrangement through the fastener passage opening and fastener feed hole, (c) means for feeding the fastener assembly to said tubular arrangement, the feeding means engaging the strap to advance the strap, (d) first means for actuating the fastener assembly feed means, and (e) second means for actuating the separation means, said second actuation means being mounted to said fastener driver body.

2. The fastener driver as recited in claim 1, wherein a pair of nosepieces are pivotably mounted within a pair of notches defined in opposite places of the front of the wall of said tubular arrangement, an annular coil spring seated around outer portions of the nosepieces to urge the nosepieces to close together, and a pair of stops are provided within the notches and in contact with inner portions of the nosepieces so as to align the nosepieces with said tubular arrangement.

3. The fastener driver as recited in claim 1, wherein said tubular arrangement is telescopic so that a rear tube of said tubular arrangement is fixed to said fastener driver body and a front tube of said tubular arrangement defines the fastener outlet, said tubular arrangement including a spring urging said tubular arrangement to extend.

4. The fastener driver as recited in claim 1, wherein the pair of fastener guiding plates are pivotably adjoined so as to close and open to each other, a rotatable shaft of a feed roller of the fastener feed means is journalled on two opposite plates provided on a support supporting at least one of the fastener guiding plates, a cylindrical surface of the rotatable shaft defines a spiral groove, an annular ratchet wheel is axially slidably mounted on the rotatable shaft so that the inner cylindrical surface of the ratchet wheel has a camming projection engaging the spiral groove, the first actuation means engages an actuation rod, the actuation rod is axially movably supported on the support generally parallel to the rotatable shaft, and an actuation block is fixed to the actuation rod, engages axially opposite ends of the ratchet wheel and has a pawl in engagement with the ratchet wheel preventing a reverse rotation of the ratchet wheel.

5. The fastener driver as recited in claim 1, an outer cylindrical portion of a feed roller of the fastener feed means has projections equiangularly arranged circumferentially of the feed roller so that the projections of the feed roller engage feed pitch holes defined in the strap of the fastener assembly.

6. The fastener driver as recited in claim 1, wherein the pair of fastener guiding plates are pivotably adjoined to each other so as to close and open to each other, the other fastener guiding plate has a pair of front and rear plates and a side plate extending between the front and rear plates and spaced a predetermined distance from the other fastener guiding plate so as to pivotably support a fastener separation element of the fastener separation means, the front end of said tubular arrangement has a tubular guide fixed thereto for linearly guiding the second actuation means, the tubular guide extending generally parallel to the axis of said tubular arrangement, the tubular guide has a slide plate slidable therealong, the slide plate engages a lever rotatably mounted on said tubular arrangement so that a rotation of the lever causes a linear movement of the slide plate, the side plate has a linkage mounted thereto and comprising an arm engaging a rear portion of the fastener separation element, the linkage includes an input link engaging the slide plate, the second actuation means has stepwise arranged actuation surfaces and axially movably passes into the tubular guide, one end of the lever passes through a slot defined in the tubular guide and engages the actuation surfaces so that a rotation of the lever associated with a linear movement of the second actuation means is imparted through the slide plate to the input link.

7. The fastener driver as recited in claim 1, wherein the pair of fastener guiding plates are pivotably adjoined to each other so as to close and open to each other, the other fastener guiding plate has a pair of front and rear plates and a side plate extending between the front and rear plates and spaced a predetermined distance from the other fastener guiding plate so as to pivotably support a fastener separation element of the fastener separation means, a pair of arms one of which engages a rear portion of the fastener separation element are pivotably mounted to the side plate, the other arm engages a pivotable element supported on a bottom plate fixed to the side plate, a pull bar extending from the inside to outside of the rear plate, the second actuation means passes into a tubular guide fixed to said tubular arrangement and has a rectangular U-shaped cross section, a surface of the second actuation means constituting the front edge surface of one prong of the cross section of the second actuation means provides an actuation surface engaging one end of a lever which passes through a slot defined in the tubular guide and which is pivotably mounted to a support common to the tubular guide, the lever being also slidable along a shaft, a pin passes through, freely engages a slot defined in the lever and is mounted to a slide plate, slidably mounted to the tubular guide and the slide plate engages the pull bar.

8. A fastener driver for a fastener assembly of fastener arranged with a predetermined pitch along the axis of a strap retaining the fasteners, comprising:

a fastener driver body having a rod-shaped drive bit rotated by a powered motive source;

a tubular arrangement mounted to said fastener driver body, the tubular arrangement being extendable and contractable axially of said tubular arrangement, said tubular arrangement having a front end defining a fastener outlet, the drive bit being advanced in and axially of said tubular arrangement when a fastener is driven; and a fastener feeder mounted to said tubular arrangement and having the following arrangements (a) to (g), (a) wherein a first case and a second case are closable and openable about a pivot to each other, the first case comprises a fastener guiding plate defining a fastener passage opening, a side plate, a bottom plate, and front and rear plates, said tubular arrangement is provided between the first fastener guiding plate and side plate so that a fastener feed hole defined in a wall of said tubular arrangement and a fastener passage opening defined in the first guiding plate are opposed to each other, the second case comprises one side plate, front and rear plates, a top plate, and a bottom plate, the second case including a second fastener guiding plate mounted within an opening defined by the plates of the second case, (b) wherein a feed roller having projections engageable with pitch feed holes defined in the strap, and a rotatable shaft which has the feed roller fixed thereto and which has a spiral groove thereon adjacent the feed roller are supported on the front and rear plates of the second case, a ratchet wheel axially slidably fits the rotatable shaft so that a projection provided on the inner cylindrical surface of the ratchet wheel engages the spiral groove, the ratchet wheel cooperates with a pawl preventing a reverse rotation of the ratchet wheel, an actuation rod supported on the front and rear plates of the second case has an actuation block engaging axially opposite ends of the ratchet wheel and having the pawl attached thereto, (c) wherein a first actuator mounted to said fastener driver body is movable to engage the actuation rod, (d) wherein a fastener separation element which passes into and out of an opening defined in the second fastener guiding plate and which separates from the strap a fastener positioned within a fastener passage opening defined in the first fastener guiding plate and which feeds the separated fastener into said tubular arrangement through a fastener feed hole defined in the wall of said tubular arrangement is pivotably mounted on the side plate of the second case, one of a pair of arms pivotably mounted to the side plate of the second case engages a rear portion of the fastener separation element, the other arm engages a pivotable element supported on a bottom plate fixed to the side plate of the second case, and a pull bar engaging the pivotable element passes through the rear plate out of the second case, (e) wherein a second rod-shaped linear actuator passes into a tubular guide mounted to the underside of the first or second case and has a rectangular U-shaped cross section, a surface of the second actuator constituting the front edge surface of one prong of the cross section of the second linear actuator provides actuation surfaces engaging one end of a lever which passes through a slot defined in the tubular guide and which is pivotably mounted to a support common to the tubular guide by means of a shaft, the lever also being slidable along the shaft, a pin passes through, freely engages a slot defined in the lever and is mounted to the slide plate fixed to the support, and the slide plate engages a pull bar, (f) wherein the first and second cases are closable to each other so that the first and second fastener guiding plates are opposite each other with a clearance therebetween sufficient to pass the fastener assembly, and (g) wherein a magazine which supports the fastener assembly is mounted to the undersides of the first and second cases.

* * * * *